US007022026B2

(12) United States Patent
Blankenship

(10) Patent No.: US 7,022,026 B2
(45) Date of Patent: Apr. 4, 2006

(54) GOLF CLUB SWING ANALYZERS

(75) Inventor: Charles H. Blankenship, 3860 Country Club Dr., Lewiston, ID (US) 83501

(73) Assignee: Charles H. Blankenship, Lewiston, ID (US)

( * ) Notice: Subject to any disclaimer, the term of this patent is extended or adjusted under 35 U.S.C. 154(b) by 914 days.

(21) Appl. No.: 09/785,859

(22) Filed: Feb. 16, 2001

(65) Prior Publication Data

US 2001/0017347 A1 Aug. 30, 2001

Related U.S. Application Data

(62) Division of application No. 09/205,045, filed on Dec. 4, 1998, now Pat. No. 6,227,984

(60) Provisional application No. 60/083,892, filed on May 1, 1998.

(51) Int. Cl.
*A63B 57/00* (2006.01)

(52) U.S. Cl. ..... 473/221; 473/222; 473/225; 473/233; 473/257

(58) Field of Classification Search ..... 473/221, 473/222, 225, 233, 257
See application file for complete search history.

(56) References Cited

U.S. PATENT DOCUMENTS 4,146,230 A * 3/1979 Foster ..... 473/221
4,251,077 A * 2/1981 Pelz et al. ..... 473/222
4,341,384 A 7/1982 Thackrey
4,477,079 A * 10/1984 White ..... 473/221
4,997,189 A * 3/1991 Perkins ..... 473/221
5,087,047 A 2/1992 McConnell
5,257,084 A 10/1993 Marsh
5,324,039 A 6/1994 Reimers et al.
5,538,251 A 7/1996 Harper
5,692,966 A * 12/1997 Wash ..... 473/221
5,718,639 A * 2/1998 Bouton ..... 473/151
6,227,984 B1 * 5/2001 Blankenship ..... 473/221

* cited by examiner

*Primary Examiner*—Jessica Harrison
*Assistant Examiner*—Corbett B Coburn
(74) *Attorney, Agent, or Firm*—Wells St. John, P.S.

(57) ABSTRACT

According to one aspect of the present invention, a golf club swing analyzer provides a housing; a light emission device configured to emit reference light toward a location in the path of a golf club swung adjacent the housing; a light reception device supported by the housing and configured to receive reference light emitted from the light emission device and reflected from the swung golf club; and discrimination circuitry coupled with the light reception device and configured to distinguish the reflected reference light received from the light emission device from incidental light, the discrimination circuitry being further configured to generate an indication signal responsive to the reception of reflected reference light.

27 Claims, 10 Drawing Sheets

GOLF CLUB SWING ANALYZERS

CROSS REFERENCE TO RELATED APPLICATIONS

This application claims priority from U.S. Provisional Application Ser. No. 60/083,892, filed May 1, 1998, titled "Indoor-Outdoor Sensor System for Golf Swing Analyzers", naming Charles H. Blankenship as inventor, and incorporated herein by reference.

RELATED PATENT DATA

This patent resulted from a divisional application of U.S. patent application Ser. No. 09/205,045, filed Dec. 4, 1998, now U.S. Pat. No. 6,227,984 entitled "Golf Club Swing Analyzers and Golf Club Swing Analyzer Methods", naming Charles H. Blankenship as inventor and which claimed priority from U.S. Provisional Application Ser. No. 60/083,892, filed May 1, 1998, the disclosures of which are incorporated by reference.

TECHNICAL FIELD

This invention relates to golf club swing analyzers and golf swing analysis methods.

BACKGROUND OF THE INVENTION

Electronic golf swing analyzers have been used to assist people En with monitoring characteristics of their individual golf swing. Some configurations generally use some form of light detector (e.g., phototransistor, photo cell, etc.) as a sensor for use in swing analysis. However, the prior art designs suffer from the same limitation wherein they perform adequately indoors with a stationary overhead light source, but fail to operate properly when utilized outdoors. More specifically, measurements of conventional swing analyzers become erratic and inaccurate in the presence of the moving sun during outdoor use. These machines are not reliable when used outdoors.

Referring to FIG. 1, one conventional optoelectronic golf swing analyzer configuration is shown. An array of light sensors 12 is imbedded in a hitting platform 10 in reasonably close proximity to a golf ball 11 to be struck by an approaching golf club 14. A lamp 13 is mounted in a fixed position above sensor array 12 to provide a source of infrared light for sensor array 12.

As the clubhead of golf club 14 approaches golf ball 11, the light 8 is blocked from some of the sensors of array 12 and this condition is subsequently detected. Sensor array 12 is arranged in a specific pattern that allows detection of the position and timing of the clubhead of club 14 in the impact area of golf ball 11. From this data, important information about the golf swing can be calculated and displayed. For example, clubhead path, clubface angle, clubhead speed, impact point of ball upon the clubface, tempo or swing time, ball velocity and ball carry are exemplary parameters which may be calculated and displayed to the user.

The type of device illustrated in FIG. 1 functions properly when used indoors with a fixed overhead light source, such as lamp 13. However, when the device is used outdoors and especially in the sun, several factors have a negative influence on performance which preclude accurate detection of clubhead timing and position.

FIG. 2 shows a typical sensor circuit for a conventional optoelectronic swing analyzer arrangement. The depicted circuit comprises a light detector 21 coupled with a resistor 22 and comparator circuit 23. A steady state source of light

20 from lamp 13 (not shown) illuminates light detector 21 which provides a high signal output (+V) due to the light current flowing through resistor 22. When the clubhead passes over light detector 21, the light current is reduced and the output signal goes to a logic low (0) state. The output signal is routed to logic gate or comparator 23 which detects this change in output signal from resistor 22. The change in the output signal indicates the passage of the clubhead.

Referring to FIG. 3-FIG. 5, problems typically experienced with the utilization of such conventional devices in the outdoors is illustrated. If the analyzer is exposed to the sun, device operation becomes erratic inasmuch as sunlight contains more intense infrared energy than the overhead lamp. Thus, sensors 21 tend to respond to the presence or absence of sunlight.

Further, other sources of error can be attributed to the fact that the sun is constantly moving such that the light source for the detectors comes from many different directions depending upon the time of day. A plurality of sensors 21 are sequentially labeled 1 thru 13 in FIG. 3-FIG. 5. The sun is directly overhead in the illustration of FIG. 3 and plural light rays 30 therefrom radiate straight down casting a shadow 31 directly under the clubhead of club 14. Sensors 21 numbered 4 thru 8 are blocked from light 30 in FIG. 3.

The position of the sun in FIG. 4 is to the right of club 14 and light rays 30 are angled from right to left in a downward direction creating shadow 31 that lags the clubhead of club 14 (assuming the clubhead is moving from left to right in FIG. 4). Sensors 21 numbered 1 thru 6 are blocked from the sun in FIG. 4 although the position of the clubhead of club 14 with respect to sensors 21 is identical in FIG. 3-FIG. 5.

The sun is to the left of club 14 in FIG. 5 with light rays 30 angled from left to right in a downward direction creating shadow 31 that leads clubhead 14 (again assuming movement of the club in a direction from left to right). Sensors 21 numbered 6 thru 12 are blocked from light 30 from the sun in this case.

Although clubhead 14 is in the same exact position in the above illustrations with respect to sensors 21, the actual sensors 21 that are blocked from the light source (e.g., the sun) change as the light source moves. This creates errors in measurement of clubhead position. Furthermore, any given sensor 21 is blocked from the light source at a different time during the swing as the sun moves across the sky. This creates errors in timing measurements.

The problem is further complicated by the fact that the intensity of the light seen by the sensors 21 also changes as the sun moves. The light is most intense when the sun is directly above sensors 21 as shown in FIG. 3, and least intense in the morning and evening hours corresponding to FIG. 4 and FIG. 5. Other sources of measurement errors include reflections of light from the leading edge of the clubhead and shadows cast by nearby objects across the array of sensors 21.

One way to reduce problems associated with the use of conventional devices outdoors includes completely shading all sensors 21 of this type analyzer from sunlight so that only light from overhead light 13 reaches the light detectors 21. Such could include using the analyzer in a tent with the associated costs and inconvenience.

As is readily apparent, the above configurations prove problematic in a prime desired application of the analyzer—use outdoors. Further, the suggested solutions have associated drawbacks which reduce the attractiveness or feasibility of utilizing the conventional devices outdoors.

Referring to FIG. 6 and FIG. 7, another technique used in some conventional configurations to detect a clubhead is illustrated. An emitter 34 is positioned to radiate a steady beam of light 35 in an upward direction. When the clubhead of club 14 passes over light 35, a portion of the light is reflected down and increases the light current through a phototransistor 37 which produces a voltage response across an associated resistor 38.

These circuit configurations will typically not operate properly in direct sunlight because infrared energy emitted from the sun is much more intense than that of emitter 34. Accordingly, any change in phototransistor current caused by sunlight will overpower any small change in current due to reflected light energy 35.

Some devices have been designed to use horizontal beams of light energy in an effort to overcome problems caused by sunlight. The emitters and detectors are housed in boxes that protect associated sensors from direct sunlight. Such sensors are typically configured to detect the moment a clubhead breaks a horizontal beam of light. There are a number of patents that describe such devices, including U.S. Pat. No. 5,692,966, U.S. Pat. No. 5,257,084, U.S. Pat. No. 5,324,039 and U.S. Pat. No. 5,087,047.

A significant drawback with these designs is that the devices are usually restricted to calculating timing measurements of the moving clubhead without providing position measurements. Therefore, such devices are limited to measuring clubhead speed and tempo. Additional important swing parameters such as clubhead path, clubface angle and at the impact point of the ball on the clubface require position information of the clubhead.

Therefore, a need exists to provide a sensing system and methodologies that overcome the limitations of the above-described configurations, and produce accurate measurements both indoors and outdoors, and during night or day.

BRIEF DESCRIPTION OF THE DRAWINGS

Preferred embodiments of the invention are described below with reference to the following accompanying drawings.

FIG. 14 is a schematic diagram of one embodiment of a discrimination circuit of the swing analyzer shown in FIG. 8.

DETAILED DESCRIPTION OF THE PREFERRED EMBODIMENTS

Figure 1:
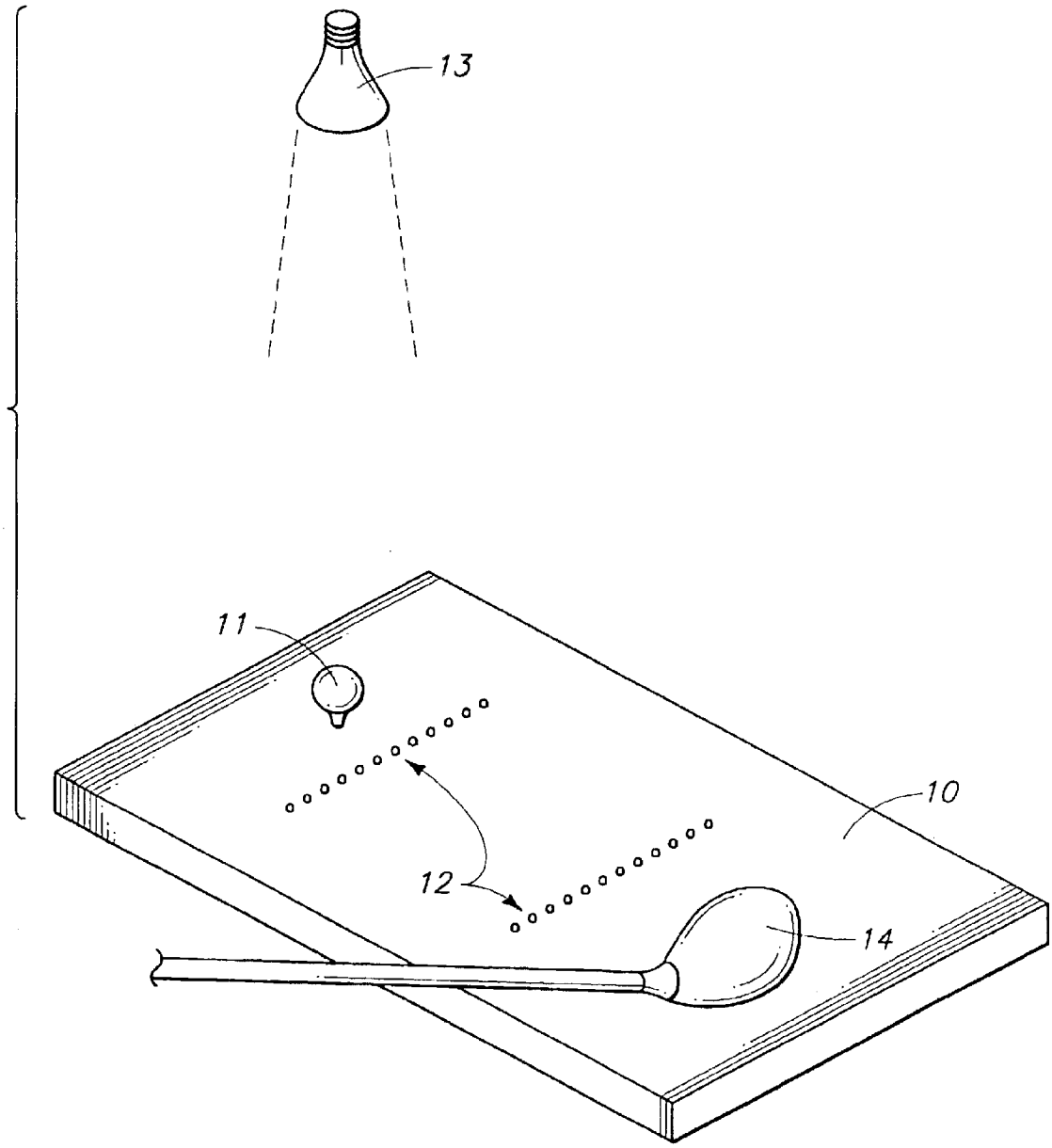
Fig 1 PRIOR ART
FIG. 1 is an isometric view of a conventional swing analyzer configuration.
Figure 2:
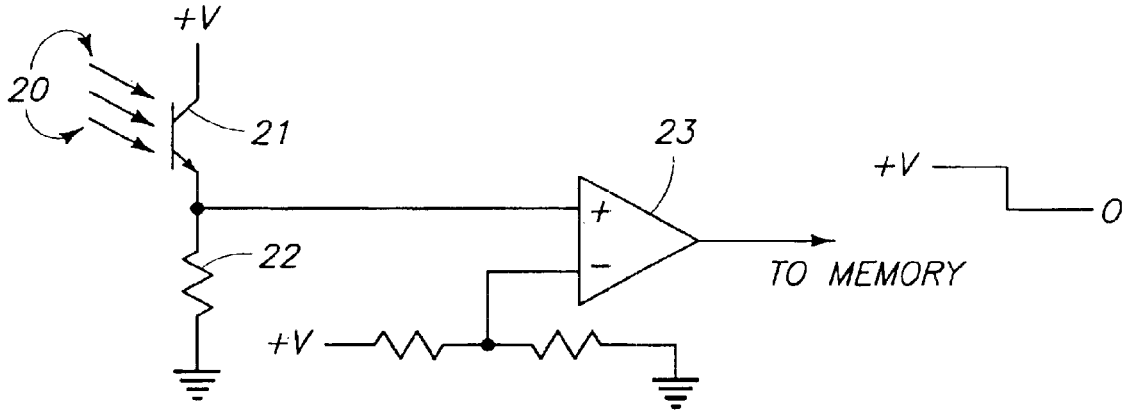
Fig 2 PRIOR ART
FIG. 2 is a schematic diagram of sensor circuitry of the swing analyzer shown in FIG. 1.
Figure 3:
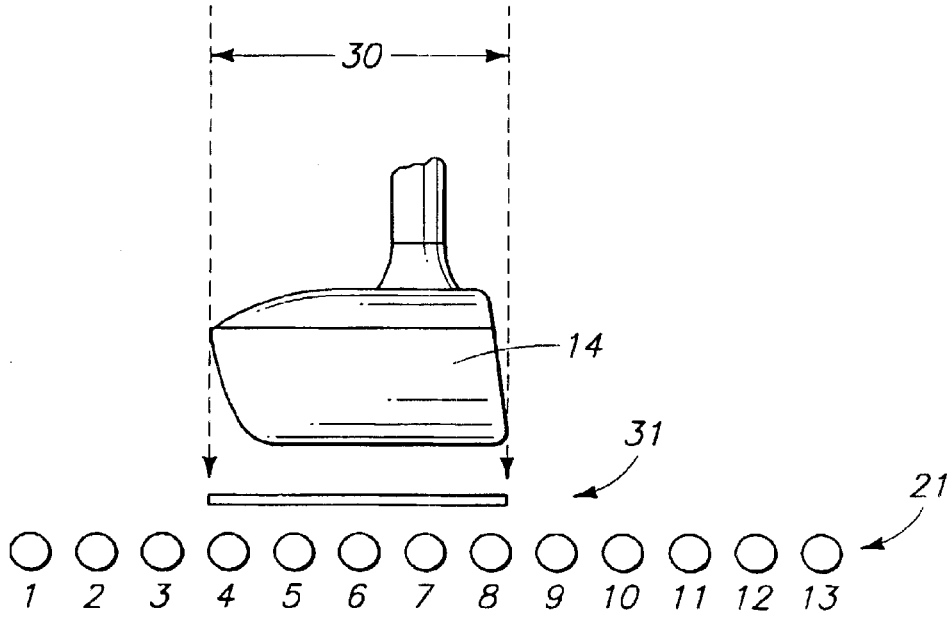
Fig 3 PRIOR ART
FIG. 3-FIG. 5 are diagrammatic representations of the effects of the sun when the swing analyzer of FIG. 1 is utilized outdoors.
Figure 4:
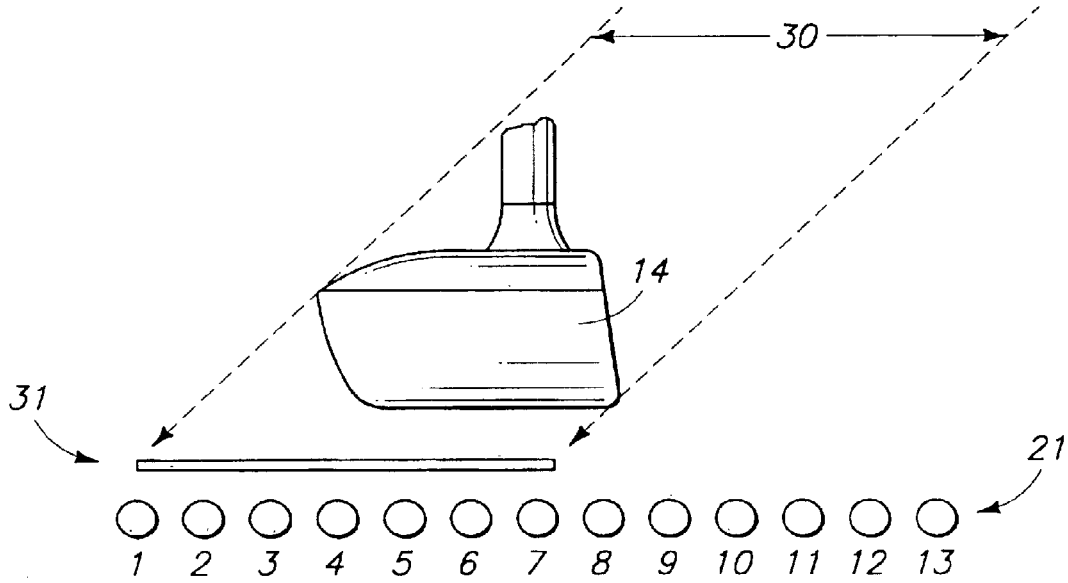
Fig 4 PRIOR ART
Figure 5:
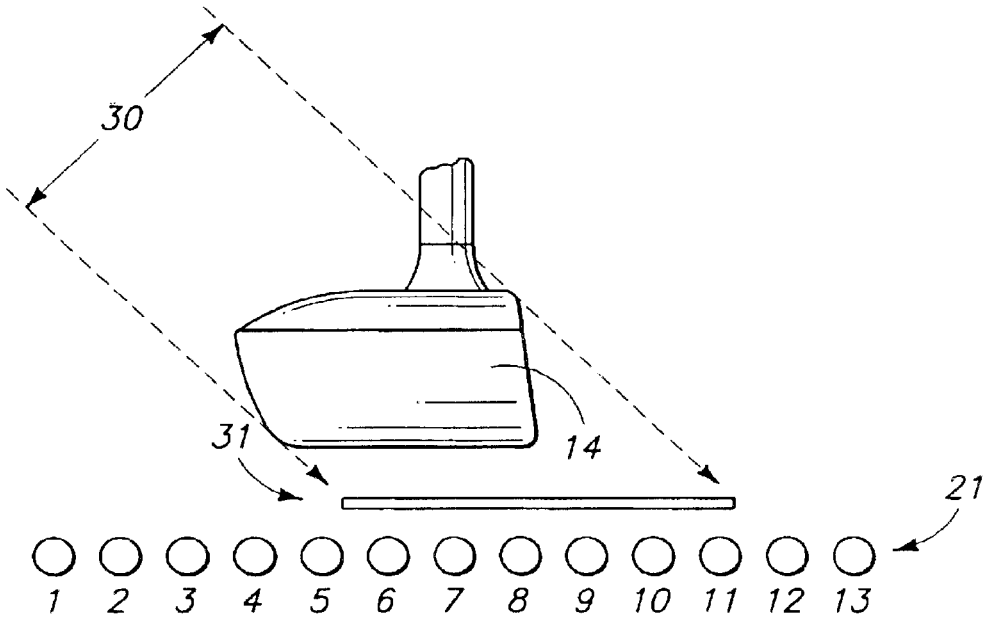
Fig 5 PRIOR ART
Figure 6:
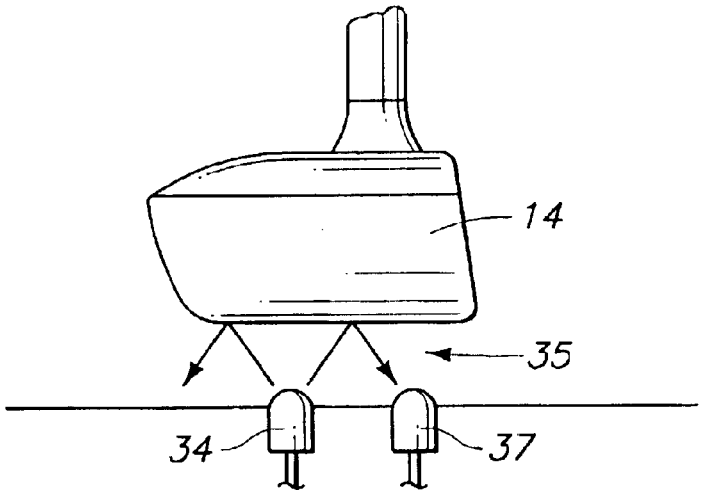
FIG 6 PRIOR ART
FIG. 6 is an elevated side view depicting a golf club over a sensor configuration of the swing analyzer of FIG. 1.
Figure 7:
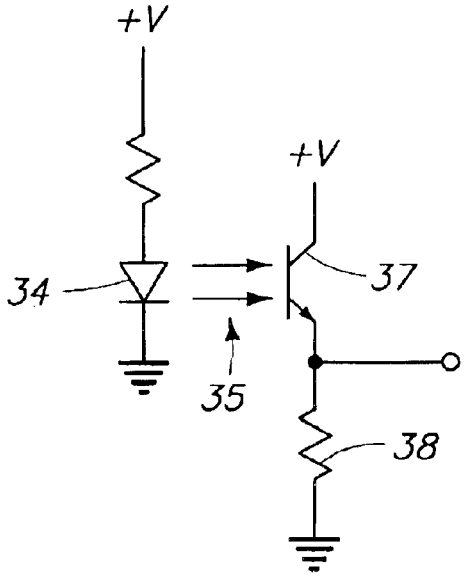
FIG 7 PRIOR ART
FIG. 7 is a schematic diagram of circuitry corresponding to FIG. 6.

This disclosure of the invention is submitted in furtherance of the constitutional purposes of the U.S. Patent Laws "to promote the progress of science and useful arts" (Article 1, Section 8).

According to one aspect of the present invention, a golf club swing analyzer comprises: a housing; a light emission device configured to emit reference light toward a location in the path of a golf club swung adjacent the housing; a light reception device supported by the housing and configured to receive reference light emitted from the light emission device and reflected from the swung golf club; and discrimination circuitry coupled with the light reception device and configured to distinguish the reflected reference light received from the light emission device from incidental light, the discrimination circuitry being further configured to generate an indication signal responsive to the reception of reflected reference light.

Another aspect of the present invention provides a golf club swing analyzer comprising: a housing; a light emission device configured to emit reference light in a substantially vertical direction toward a location in the path of a golf club swung adjacent the housing, the light emission device being further configured to emit the reference light in a plurality of pulses individually having a duration less than the duration of one of the rise time and fall time resulting from the swung golf club blocking incidental light from the light reception device; a light reception device supported by the housing and configured to receive reference light emitted from the light emission device and reflected from the swung golf club; and discrimination circuitry coupled with the light reception device and configured to distinguish the reflected reference light received from the light emission device from incidental light including generating a timed pulse responsive to reference light being received within the light reception device, the timed pulse having a duration greater than the duration of the reference light pulses and less than an individual one of the rise time and fall time.

According to another aspect of the present invention, a golf swing analysis method comprises: emitting reference light toward a location in the path of a golf club swung adjacent the housing; receiving reference light reflected from the swung golf club; receiving incidental light; discriminating the reflected reference light and the incidental light following the receivings; generating at least one indication signal responsive to the discriminating.

The present invention provides a golf swing analyzer and golf swing analysis method configured to overcome limitations of the prior art devices. The swing analyzer according to the present invention includes sensors which provide accurate measurements of a golf club both indoors and outdoors and during night or day. The described swing analyzer operates without the use of an overhead light source and there is no need to shade the device from sunlight or other incidental light, also referred to as environmental light. According to the described embodiment, the depicted swing analyzer utilizes an electronic circuit configured to reject sensor responses caused by changes in illumination from incidental light including sunlight. As described in detail below, the preferred swing analyzer configuration of the invention utilizes a self-contained light source to create circuit responses. The swing analyzer operates properly in any lighting environment from direct sunlight to near total darkness. The disclosed swing analyzer implements a sensing technique with improved convenience, usefulness, accuracy and reliability of operation.

Figure 8B:
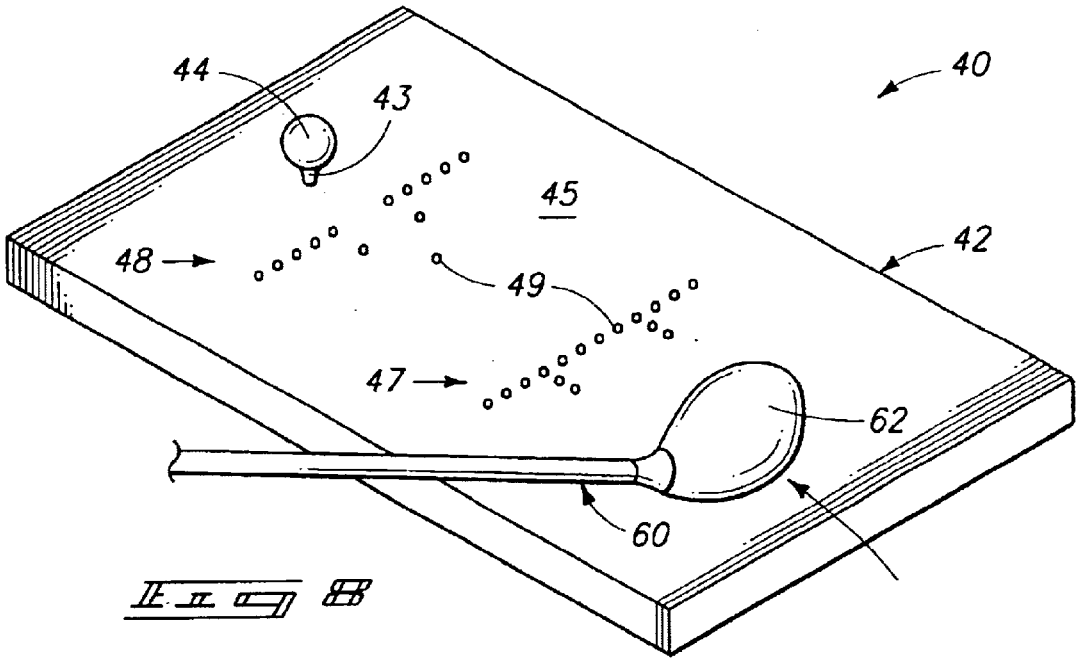
FIG. 8 is an isometric view of a swing analyzer according to the present invention.

Referring to FIG. 8, one embodiment of a golf swing analyzer 40 according to the present invention is illustrated. The depicted golf swing analyzer 40 includes a housing 42, such as a hitting platform. In the illustrated embodiment, a tee 43 is coupled with housing 42 and configured to receive a golf ball 44. A golf club 60 having a clubhead 62 is swung adjacent housing 42 in the indicated direction to provide analysis of a user's golf swing.

Housing 42 includes an upper surface 45 configured to face upwardly away from the ground or other similar support surface upon which golf swing analyzer 40 may be positioned. Tee 43 extends upwardly from upper surface 45.

In the depicted configuration of the present invention, plural sensor arrays 47, 48 are provided embedded within upper surface 45 of housing 40. Individual sensor arrays 47, 48 comprise a plurality of sensor configurations generally individually depicted with reference numeral 49 in FIG. 8.

Sensor configurations 49 are provided in predefined positions upon and/or within housing 42. More specifically, plural sensor arrays 47, 48 including sensors 49 are arranged in a configuration to provide measurements of position and timing of clubhead 62 in the impact area with golf ball 44. Such provides important information or characteristics regarding a golf swing. Exemplary characteristics include clubhead path, clubface angle, clubhead speed, impact point of ball on the clubface, tempo or swing time, ball velocity, and ball carry. These parameters can be calculated and displayed to the user.

Figure 9:
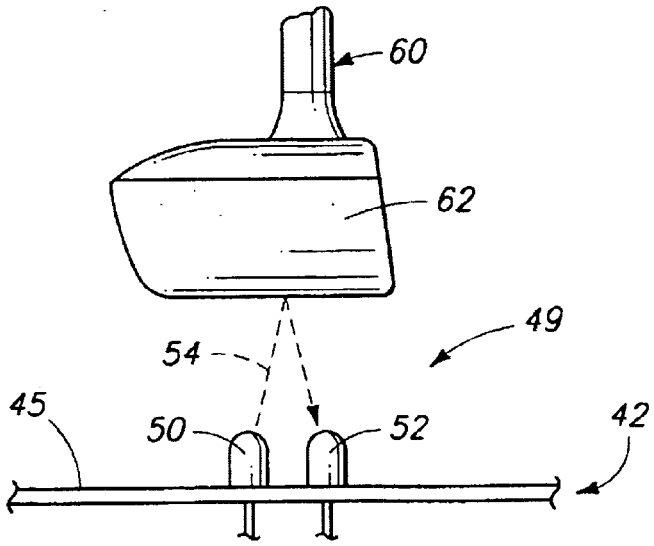
FIG. 9 is an elevated side view of a golf club adjacent a sensor configuration of the swing analyzer of FIG. 8.

Referring to FIG. 9, an exemplary embodiment of sensor configuration 49 is illustrated. In particular, reflected light is used in the described embodiment to provide desired measurements. Such operation of reflecting reference light off a swung club 60 is described with reference to FIG. 9. The depicted sensor configuration 49 comprises a light emission device 50 and a corresponding light reception device 52 coupled with and supported by housing 42. In the described embodiment, light emission device 50 is configured to emit reference light 54 and light reception device 52 is configured to receive the reference light reflected by clubhead 62.

In one configuration, light emission device 50 comprises an infrared (IR) emitting diode configured to emit infrared light energy. Device 50 has part designation SFH484 available from Siemens AG in one embodiment.

The preferred requirements for light detector or light reception device 52 include small size, capable of sensing high frequency pulses and capable of operating in direct sunlight without going into a condition of saturation. From many available light detector devices, a high frequency photodiode is utilized in the preferred embodiment of the invention. In particular, light reception device 52 comprises a photodiode sensitive to the infrared band and has part designation SFH203FA available from Siemens AG in the described embodiment. Alternatively, light reception device 52 can comprise a phototransistor. Other sensor configurations 49 are possible.

In typical use, a user swings golf club 60 having clubhead 62 adjacent housing 42 and sensor configurations 49. Preferably, a user swings club 60 such that clubhead 62 passes approximately 0.5 inches above surface 45 of housing 42.

According to the preferred embodiment, light emission device 50 is configured to emit reference light 54 in a substantially vertical direction. Emission and reception devices 50, 52 are configured to respectively radiate and detect vertical light beams in the described embodiment. Further, devices 50, 52 forming individual sensor configurations 49 may be positioned in an appropriate array similar to that shown in FIG. 8 in order to provide clubhead position measurements with respect to the golf ball or target line.

Light emission device 50 is configured to emit reference light 54 toward a location in the path of golf club 60 swung adjacent housing 42. Such location can comprise the position of clubhead 62 shown in FIG. 9. During a swinging motion of club 60, clubhead 62 passes adjacent housing 42 and through the predefined location. Clubhead 62 operates to reflect emitted reference light 54 when positioned in the predefined location shown in FIG. 9.

Emission device 50 and reception device 52 are preferably mounted side by side in close proximity such that reflected reference light 54 is directed toward light reception device 52. Light reception device 52 is configured to receive reference light 54 emitted from light emission device 50 and reflected from clubhead 62 of the swung golf club 60.

Figure 10:
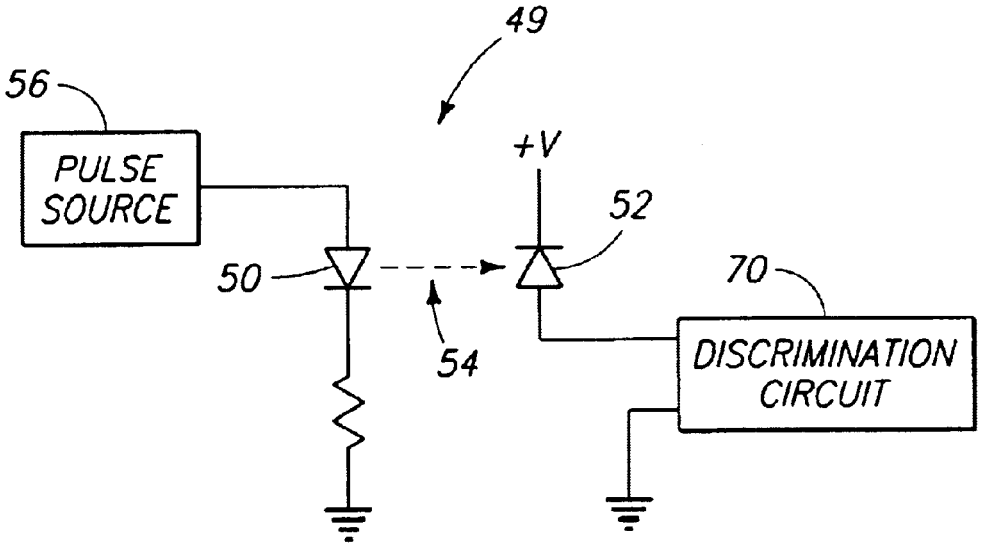
FIG. 10 is a schematic diagram illustrating circuitry corresponding to the swing analyzer of FIG. 9.

Referring to FIG. 10, a circuit diagram corresponding to the sensor configuration 49 of FIG. 9 is illustrated. In particular, light emission device 50 of sensor 49 is coupled with a pulse source or generator 56. Light reception device 52 of sensor 49 is coupled with discrimination circuitry 70.

Pulse source 56 applies a plurality of pulses at a predefined frequency to light emission device 50. This causes emission of reference light 54 at the frequency of the generated pulses. As described in detail below, the pulses preferably comprise high frequency pulses having a frequency in the range of 60 kHz or higher and a duty cycle of approximately 50%. If clubhead 62 is provided in the predefined location of FIG. 9, pulses of reference light 54 are reflected by clubhead 62 and applied to light reception device 52. Such causes a current to flow through light reception device 52 and permits detection of club 60 at the predefined location shown in FIG. 9.

As previously mentioned, swing analyzer 40 is configured to operate indoors as well as outdoors. Incidental light, such as sunlight or incandescent light, is typically present in both indoors and outdoors environments. Passage of clubhead 62 through the predefined location above sensor configuration 49 temporarily blocks the passage of incidental light to sensor configuration 49. Swing analyzer 40 is configured to eliminate the effects of blocked incidental light upon sensor configuration 49.

Figure 11:
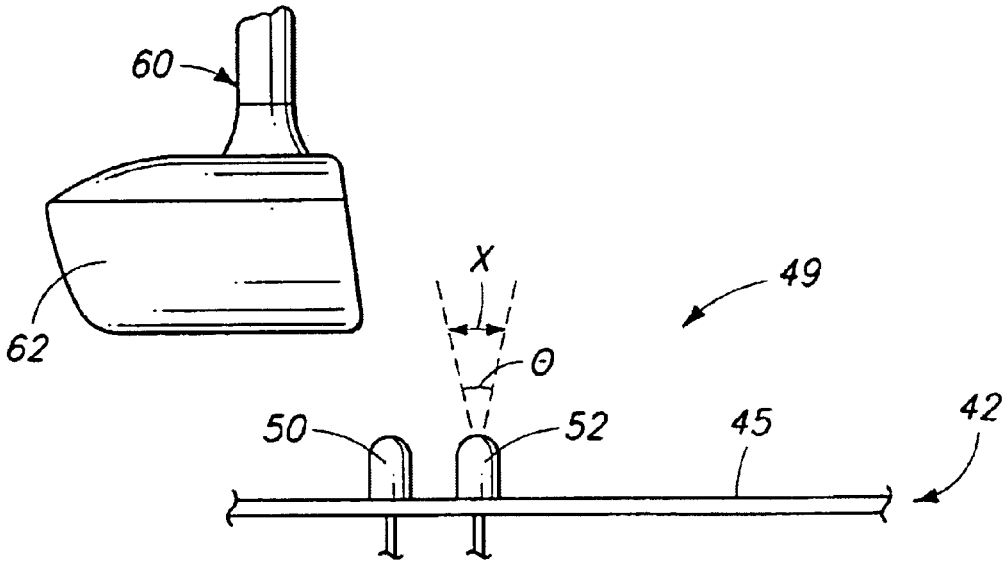
FIG. 11 is an elevated side view illustrating movement of a golf club above the sensor configuration of FIG. 9.

Referring to FIG. 11, operation of sensor configuration 49 is described with reference to temporary blockage of incidental light 1, present within the operating environment. According to the described embodiment, light reception device 52 includes an acceptance angle θ. An exemplary acceptance angle θ of photodiode light reception device 52 is approximately 16 degrees. A distance x is defined as the distance clubhead 62 passes through the acceptance angle of light reception device 52. Distance x is approximately 0.14 inches if clubhead 62 is swung approximately 0.5 inches above surface 45 of housing 40 and the acceptance angle θ is 16 degrees.

As clubhead 62 passes a distance x through the area defined by angle θ, incidental light is blocked from light reception device 52. Blockage of incidental light provided to light reception device 52 reduces the current flow through light reception device 52. However, the blockage of incidental light is not instantaneous but gradually occurs as clubhead 62 sweeps through distance x of the area defined by angle θ. Thus, the current through light reception device 52 gradually changes during passage of clubhead 62 over light reception device 52.

Figure 12:
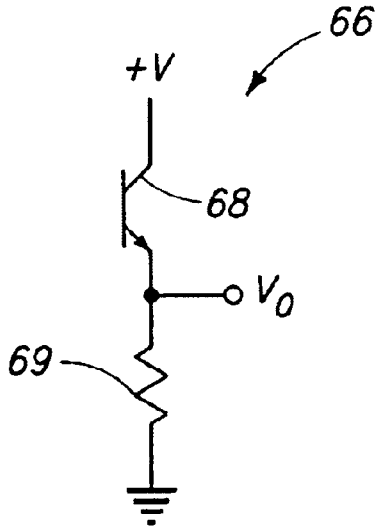
FIG. 12 is a schematic diagram illustrating circuitry of an exemplary sensor configuration.

Referring to FIG. 12, an exemplary circuit 66 for illustrating the gradual blockage of incidental light during the movement of clubhead 62 adjacent swing analyzer 40 is shown. Depicted circuit 66 comprises a light sensitive device 68 coupled intermediate a voltage supply and a resistor 69. In the illustrated configuration, light sensitive device 68 comprises a phototransistor. Device 68 can also comprise a photodiode. A reference node $V_0$ is defined at the junction of device 68 and resistor 69.

Figure 13:
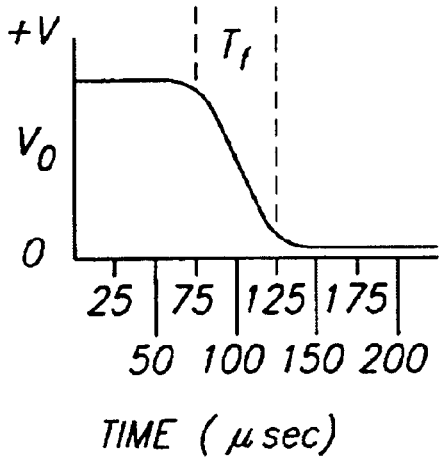
FIG. 13 is a graph depicting voltage versus time corresponding to movement of a golf club with respect to the sensor configuration of FIG. 12.
Figure 11:
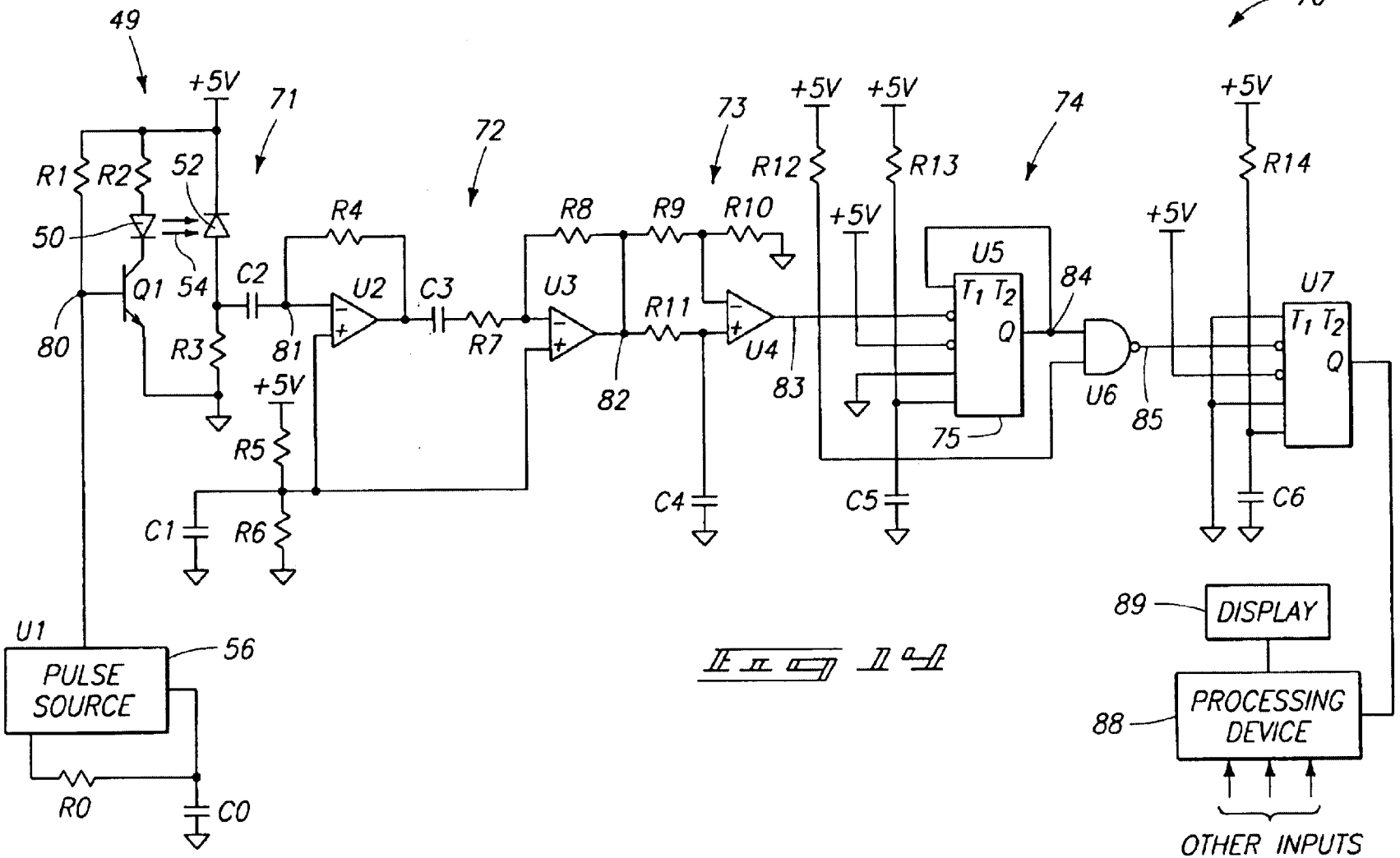
Figure 15A:
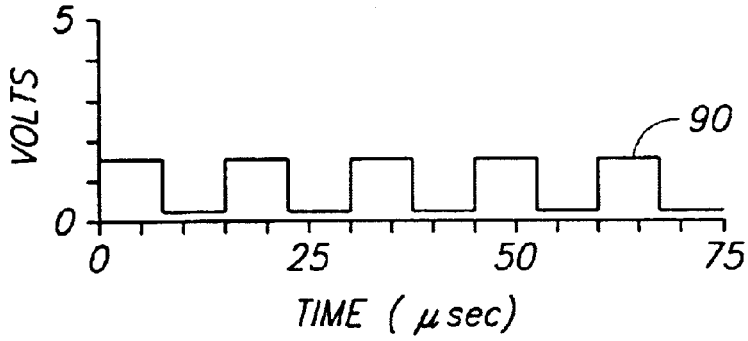
FIG. 15*a*-FIG. 15*f* are graphs illustrating respective voltages versus time at selected nodes within the discrimination circuit of FIG. 14.
Figure 15B:
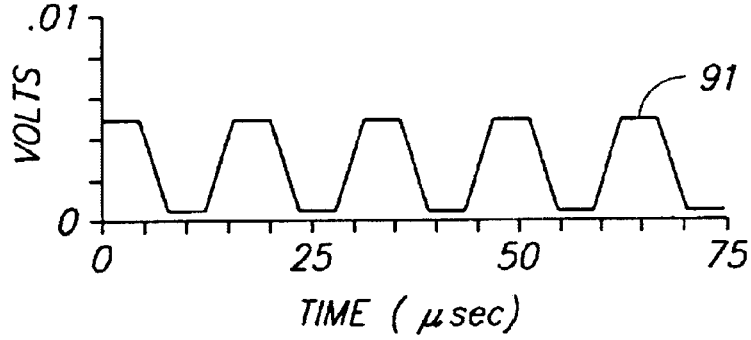
Figure 15C:
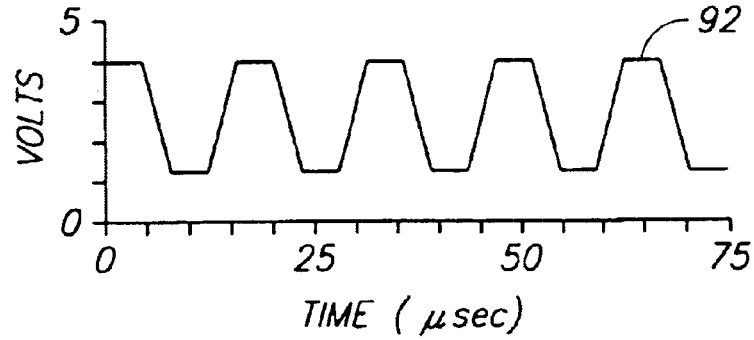
Figure 15D:
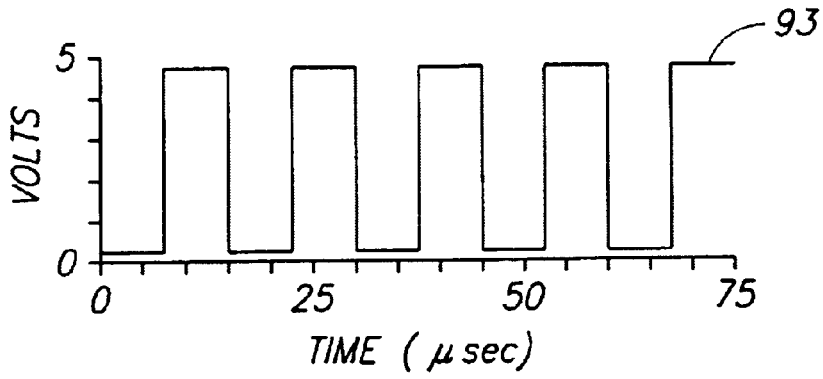
Figure 15E:
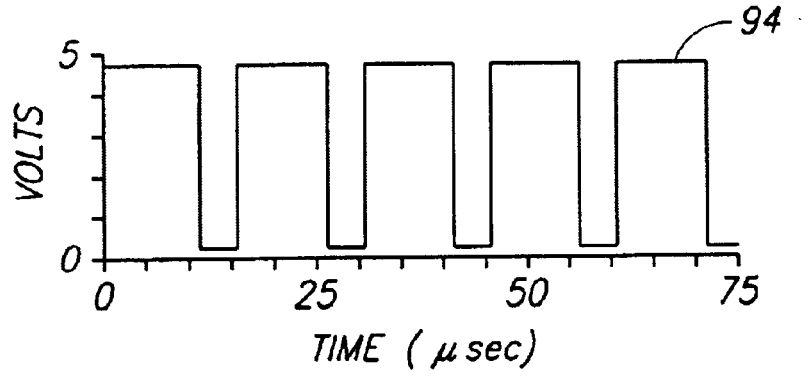
Figure 15F:
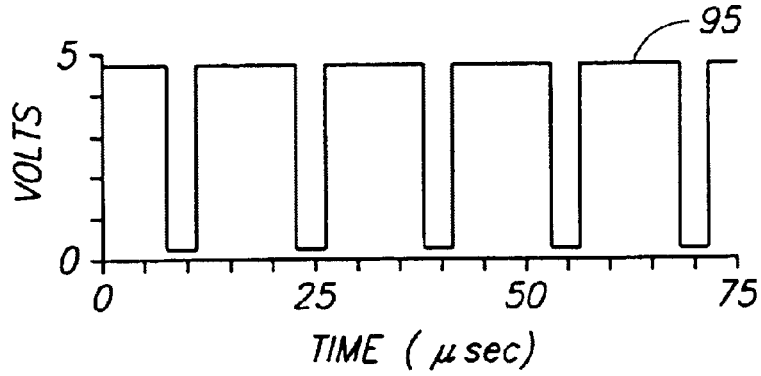

Referring to FIG. 13, a time chart corresponding to the change of current flow through device 68 responsive to a change in incidental light is shown. The depicted time chart illustrates the voltage at node $V_0$ and across resistor 69. Reduction of incidental light provided to device 68 results in reduced current flow through device 68. As the current through light emission device decreases over time, the output voltage at node $V_0$ and across resistor 69 coupled with device 52 also decreases.

If clubhead 62 moves at a maximum speed of 140 mph (2462 inches per second) across distance x, the output voltage at node $V_0$ will have a fall time $T_f$ of about 56 microseconds (μsec) as illustrated in FIG. 13. According to one embodiment of the present invention, swing analyzer 40 is configured to reject all voltage signals having fall times (or rise times) of approximately 56 microseconds or more. Such eliminates any effects of incidental light, such as the sun, upon the accuracy of swing analyzer 40.

According to one embodiment of swing analyzer 40, providing a sensor circuit that responds only to high frequency pulses effectively eliminates the effects of incidental light. Accordingly, light emission device 50 is preferably configured to provide high frequency pulses of reference light 54 in one arrangement. Infrared emitters (IR emitters), laser diodes and ultra-violet emitters are available exemplary devices that provide this capability. Light emission device 50 comprises an IR emitter in the preferred embodiment of this invention.

In other words, the time duration of the pulses comprising reference light 54 is not critical as long as they are faster than or the fastest possible pulse generated by clubhead 62 interrupting incidental light provided to light reception device 52. It is preferred that the emitted reference light pulses 54 have an individual duration less than the duration of one of the rise time and fall time resulting from the swung golf club 60 blocking incidental light upon light reception device 52.

Referring to FIG. 14, a simplified circuit diagram of an exemplary discrimination circuit 70 is illustrated coupled with a corresponding emitter-detector circuit 71 which includes sensor configuration 49 and pulse source 56. Discrimination circuit 70 is further coupled with a processing device 88 and display 89 in the described embodiment.

Discrimination circuit 70 is configured to distinguish reflected reference light 54 from incidental light. In the described arrangement, discrimination circuit 70 is configured to distinguish voltage signals having fall (or rise) times of approximately 56 microseconds or more from voltage signals having faster fall or rise times.

The depicted embodiment of discrimination circuit 70 comprises an amplifier circuit 72, comparator circuit 73, and pulse discriminator circuit 74. Amplifier circuit 72 is coupled with emitter-detector circuit 71 and pulse discriminator circuit 74 is coupled with processing device 88. Comparator circuit 73 couples amplifier circuit 72 with discriminator circuit 74.

Referring to FIG. 15, a plurality of voltage waveforms 90–95 are illustrated which correspond to voltages at a plurality of respective nodes 80–85 shown in the circuit of FIG. 14. Waveform 90 corresponds to the output voltage of pulse source 56 at node 80. Waveform 91 corresponds to the output voltage of light reception device 52 at node 81. Waveform 92 corresponds to the output voltage of amplifier circuit 72 at node 82. Waveform 93 corresponds to the output voltage of comparator circuit 72 at node 83. Waveform 94 corresponds to the output voltage of a one-shot multivibrator 75 within pulse discriminator circuit 74 at node 84. Waveform 95 corresponds to the output of pulse discriminator circuit 74 at node 85.

Referring to FIG. 14 and FIG. 15, pulse source 56 of emitter-detector circuit 71 produces a train of 15 microsecond (μs) pulses which comprise an encoding signal. The frequency of the pulses is set by resistor $R_0$ and capacitor $C_0$.

The encoding signal drives transistor Q1 which, in turn, causes emitter diode 50 to emit 15 μs pulses of infrared light energy 54. Resistor $R_2$ controls the maximum current through device 50 which determines the intensity of the infrared pulses.

When an object (e.g., clubhead 62) passes over light emitting device 50, the emitted infrared pulses comprising the reference light 54 are reflected and detected by device 52. The light current from device 52 flows through resistor $R_3$ and develops a series of fast voltage pulses shown as waveform 91. The signal comprising waveform 91 is thereafter applied to and amplified within amplifier circuit 72.

Amplifier circuit 72 in the preferred embodiment comprises two high-speed operational amplifiers $U_2$, $U_3$. Amplifiers $U_2$, $U_3$ individually have part designation AD8032 and are available from Analog Devices, Inc. in the described embodiment. The input voltage pulses of waveform 91 are first amplified by circuit $U_2$ whose gain is determined by resistor $R_4$. The signal is then coupled to amplifier circuit $U_3$ through capacitor $C_3$. The gain of this amplifier stage is determined by resistors $R_7$ and $R_8$. The voltage output of amplifier $U_3$ is waveform 92 which is applied to comparator circuit 73.

The voltage output from amplifier circuit 72 varies in amplitude 41 depending on the amount of infrared energy reflected to device 52 as illustrated by waveform 92. Comparator circuit 73 provides a fixed trigger point for comparator $U_4$ which produces a constant output voltage, as shown as voltage waveform 93, that swings from approximately 0 volts (ground) to approximately V+ (the power supply voltage of approximately 5 volts). Comparator $U_4$ has part designation to LM339 available from National Semiconductor Corporation in the 1, described embodiment. This output voltage represented by waveform 93 is constant over a wide range of levels of input voltage corresponding to waveform 92. The comparator trigger point is set by resistors $R_9$, $R_{10}$, $R_{11}$ and capacitor $C_4$.

When device 52 detects a change in light level, the output voltage of comparator 73 (e.g., waveform 93) changes. The output voltage signal from comparator circuit 73 is applied to one-shot (or monostable) multivibrator 75 (also represented as component $U_5$ in FIG. 14). The output of comparator circuit 73 is also applied to an input of a NAND gate $U_6$ in pulse discriminator circuit 74. NAND gate U6 comprises a 74HC00 available from National Semiconductor Corporation in the described embodiment. The illustrated one-shot multivibrator $U_5$ is preferably a non-retriggerable type circuit.

In the absence of an input signal from device 52, the output voltage of comparator circuit 73 is at a high level near V+ and the voltage at node 84 is at a low level near 0 volts. The low level at node 84 is applied to input 1 of NAND gate $U_6$ which holds the output voltage at node 85 at a high level.

An increase in light current through reception device 52 causes the voltage at node 83 to fall from a high level to a low level. The low level at node 83 applied to input 2 of the NAND gate $U_6$ maintains the output voltage at node 85 at a high level. Also, the high to low transition of the voltage at node 83 triggers the one-shot multivibrator $U_5$ to produce a positive output pulse at node 84. The time duration of the pulse should be less than 56 μs (i.e., the fall or rise time of blocked incidental light) and somewhat longer than 7.5 μs (i.e., one half the period of the input pulses produced by pulse source 56).

In particular, multivibrator $U_5$ is preferably configured to generate a timed pulse responsive to reference light being received within light reception device 52. The timed pulse preferably has a duration greater than the duration of a single reference light pulse and less than an individual one of the rise time and fall time resulting from the swung golf club blocking incidental light from light reception device 52. In the described embodiment, a pulse width for the timed pulse from multivibrator $U_5$ of about 12 μs is selected.

The output pulse at node 84 appears at input 1 of NAND gate $U_6$, and if the voltage at node 83 at input 2 also goes positive while input 1 is positive (within 12 μs) an indication signal comprising a negative going pulse will appear at node 85. An indication at node 85 occurs responsive to reception of emitted reference light 54 within device 52. Since incidental light generated pulses are all greater than approximately 56 μs, such do not produce an output at node 85 and the circuit will respond only to the reflected infrared fast pulses 54 emitted from device 50. Responses to incidental light, including the sun, are suppressed by discriminator circuit 74 of swing analyzer 40 of the present invention.

The output indication at node 85 is applied to another one-shot multivibrator $U_7$ in the illustrated configuration. Multivibrator $U_7$ can have the same configuration as multivibrator $U_5$. Multivibrators $U_5$, $U_7$ have part designation CD4538 in the described embodiment available from National Semiconductor Corporation. Multivibrator $U_7$ is configured to output another indication signal responsive to the reception of reflected reference light 54 within light reception device 52. The output indication signal of multivibrator $U_7$ may be routed to processing device 88 which can comprise a personal computer. Device 88 can be configured to process the indication signal and display results (i.e., at least one swing characteristic of the user's golf swing) via user display 89 comprising a computer display in one embodiment.

Exemplary values of components of discrimination circuit 70 are found in the following Table 1. Other components can be utilized.

| Component | Value |
|---|---|
| $R_0$ | 1.5 kΩ |
| $R_1$ | 470 kΩ |
| $R_2$ | 27 kΩ |
| $R_3$ | 2 kΩ |
| $R_4$ | 3.3 kΩ |
| $R_5$ | 10 kΩ |
| $R_6$ | 10 kΩ |

-continued

| Component | Value |
|---|---|
| $R_7$ | 33 kΩ |
| $R_8$ | 22 kΩ |
| $R_9$ | 15 kΩ |
| $R_{10}$ | 39 kΩ |
| $R_{11}$ | 1 MΩ |
| $R_{12}$ | 10 kΩ |
| $R_{13}$ | 5.6 kΩ |
| $R_{14}$ | 15 kΩ |
| $C_0$ | 0.001 μF |
| $C_1$ | 0.1 μF |
| $C_2$ | 0.001 μF |
| $C_3$ | 0.1 μF |
| $C_4$ | 0.01 μF |
| $C_5$ | 0.001 μF |
| $C_6$ | 0.01 μF |

The present disclosure relates to one possible embodiment of the invention. The circuit details of swing analyzer 40 can be changed while still performing the same or similar desired functions. For example, signal polarities can be reversed or substitute components utilized without changing the basic function of the sensor system.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A golf club swing analyzer comprising:

a light emission device configured to emit reference light toward a swung golf club;

a light reception device configured to receive reference light emitted from the light emission device and reflected from, the swung golf club; and discrimination circuitry coupled with the light reception device and configured to discriminate the received reference light from incidental light and to generate an indication signal responsive to the discrimination of the received reference light and the incidental light, wherein the swung golf club blocks the incidental light from being received using the light reception device and the discrimination circuitry is configured to discriminate the received reference light from the incidental light responsive to the blocking.

2. The analyzer of claim 1 wherein the discrimination circuitry is configured to generate the indication signal to indicate the reception of the received reference light.

3. The analyzer of claim 1 wherein the discrimination circuitry is configured to generate the indication signal only responsive to the reception of the received reference light.

4. The analyzer of claim 1 wherein the discrimination circuitry is configured to generate the indication signal responsive to the reception of the received reference light and not to generate the indication signal responsive to a reception of the incidental light within the light reception device.

5. The analyzer of claim 1 wherein the discrimination circuitry is configured to not generate the indication signal responsive to a reception of the incidental light within the light reception device.

6. The analyzer of claim 1 wherein the light emission device is configured to emit the reference light in a pulse having a duration less than a duration of one of a rise time and fall time resulting from the swung golf club blocking reception of incidental light within the light reception device.

7. The analyzer of claim 6 wherein the discrimination circuitry is configured to generate a timed pulse responsive to at least one of the received reference light and incidental light being received within the light reception device, the timed pulse having a duration greater than a duration of the reference light pulse and less than an individual one of the rise time and fall time.

8. The analyzer of claim 1 further comprising:

a processor coupled with the discrimination circuitry and configured to process the indication signal; and a display coupled with the processor and wherein the processor is configured to control the display to indicate detection of the swung golf club responsive to processing of the indication signal.

9. The analyzer of claim 1 further comprising:

a plurality of light emission devices provided in a plurality of predefined positions upon a housing; and a plurality of light reception devices provided in a plurality of corresponding positions upon the housing.

10. The analyzer of claim 1 wherein the incidental light comprises light not generated for use in analyzing a golf swing.

11. The analyzer of claim 1 further comprising circuitry configured to indicate the discrimination to a user responsive to the indication signal.

12. The analyzer of claim 1 wherein the discrimination circuitry is configured to provide a high input impedance to output of the light reception device having a first frequency and a low input impedance to output of the light reception device having a second frequency, wherein the high input impedance is greater than the low input impedance and the first frequency is less than the second frequency.

13. A golf club swing analyzer comprising:

circuitry configured to receive reference light from a swung golf club, to receive incidental light, to discriminate the received reference light from the received incidental light, and to generate an indication signal to indicate the reception of the received reference light responsive to the discrimination; and wherein the incidental light comprises light not generated for use in analyzing a golf swing, and the discrimination circuitry is configured to discriminate the received reference light from an entirety of all present incidental light.

14. The analyzer of claim 13 wherein the circuitry is configured to generate the indication signal only responsive to the reception of the received reference light.

15. The analyzer of claim 13 wherein the circuitry is configured to generate the indication signal responsive to the reception of the received reference light and not to generate the indication signal responsive to the reception of the received incidental light.

16. The analyzer of claim 13 wherein the circuitry is configured not to generate the indication signal responsive to the reception of the received incidental light.

17. The analyzer of claim 13 further comprising circuitry configured to emit the reference light toward the swung golf club.

18. The analyzer of claim 17 wherein the received incidental light comprises any light received by the circuitry configured to receive reference light and not emitted by the circuitry configured to emit the reference light.

19. The analyzer of claim 13 further comprising circuitry configured to emit the reference light in a pulse having a duration less than a duration of one of a rise time and fall time resulting from the swung golf club blocking the reception of incidental light.

20. The analyzer of claim 13 further comprising a display coupled with the circuitry and configured to indicate detection of the swung golf club responsive to the indication signal.

21. The analyzer of claim 13 further comprising circuitry configured to indicate the discrimination to a user responsive to the indication signal.

22. The analyzer of claim 13 wherein the circuitry is configured to provide a high input impedance to output of the light reception device having a first frequency and a low input impedance to output of the light reception device having a second frequency, wherein the high input impedance is greater than the low input impedance and the first frequency is less than the second frequency.

23. A golf club swing analyzer comprising:

a light reception device configured to receive reference light from a swung golf club and to receive incidental light;

circuitry coupled with the light reception device and configured to generate an indication signal responsive to the reception of the received reference light and not to generate the indication signal responsive to the reception of the received incidental light; and a display coupled with the circuitry and configured to indicate detection of the swung golf club responsive to the generated indication signal; and wherein the circuitry is configured to generate a pulse corresponding to the swung golf club blocking reception of incidental light from the light reception device, and the circuitry is configured to compare the generated pulse with the at least one pulse of the reference light to filter the incidental light.

24. The analyzer of claim 23 further comprising a light emission device configured to emit the reference light toward the swung golf club.

25. The analyzer of claim 23 wherein the incidental light comprises light not generated for use in analyzing a golf swing.

26. The analyzer of claim 23 wherein the circuitry is configured to provide a high input impedance to output of the light reception device having a first frequency and a low input impedance to output of the light reception device having a second frequency, wherein the high input impedance is greater than the low input impedance and the first frequency is less than the second frequency.

27. A golf club swing analyzer comprising:

a housing;

a light emission device configured to emit reference light in a substantially vertical direction toward a location in a path of a golf club swung adjacent the housing;

a light reception device supported by the housing and configured to receive reference light emitted from the light emission device and reflected from the swung golf club, wherein the light emission device is configured to emit the reference light in a plurality of pulses individually having a duration less than the duration of one of the rise time and fall time resulting from the golf club blocking incidental light from the light reception device; and discrimination circuitry coupled with the light reception device and configured to discriminate the reflected reference light received from the light emission device from incidental light by generating a timed pulse responsive to reference light being received within the light reception device, the timed pulse having a duration greater than the duration of the reference light pulses and less than an individual one of the rise time and fall time.

* * * * *

UNITED STATES PATENT AND TRADEMARK OFFICE

CERTIFICATE OF CORRECTION

PATENT NO. : 7,022,026 B2
APPLICATION NO. : 09/785859
DATED : April 4, 2006
INVENTOR(S) : Blankenship It is certified that error appears in the above-identified patent and that said Letters Patent is hereby corrected as shown below:

Col. 1, line 29, please delete “En” after “people”.

Col. 1, line 47, please delete “8” after “light”.

Col. 6, line 51, please delete “light 1,” after “dental” and insert --light--.

Col. 7, line 43, please insert -- 56μs-- before “or the”.

Col. 8, line 44, please delete “41” after “amplitude”.

Col. 8, line 52, please delete “the 1,” after “in” and insert --the--.

Signed and Sealed this

Tenth Day of June, 2008

JON W. DUDAS
*Director of the United States Patent and Trademark Office*